US005413425A

United States Patent [19]

Park

[11] Patent Number: 5,413,425

[45] Date of Patent: May 9, 1995

[54] PRINTER RIBBON DISTINGUISHING METHOD AND APPARATUS THEREOF

[75] Inventor: Mun-Bae Park, Suwon-city, Rep. of Korea

[73] Assignee: Samsung Electronics Co., Ltd., Kyungki-do, Rep. of Korea

[21] Appl. No.: 174,813

[22] Filed: Dec. 29, 1993

[30] Foreign Application Priority Data

May 14, 1993 [KR] Rep. of Korea ..... 93-8288

[51] Int. Cl.[6] ..... B41J 31/09

[52] U.S. Cl. ..... 400/240.3; 400/240.4; 400/708; 250/548

[58] Field of Search ..... 400/240, 240.1, 240.2, 400/240.3, 240.4, 708, 237, 120, 703; 250/202, 548; 356/400, 402; 358/482

[56] References Cited

U.S. PATENT DOCUMENTS 4,710,781 12/1987 Stephenson ..... 400/240.3

FOREIGN PATENT DOCUMENTS 132375 6/1986 Japan ..... 400/239
217278 9/1986 Japan ..... 400/240.3
176168 7/1988 Japan ..... 400/237
218878 9/1989 Japan ..... 400/240
147282 6/1990 Japan ..... 400/237
031080 2/1992 Japan ..... 400/240

*Primary Examiner*—Ren Yan
*Attorney, Agent, or Firm*—Sughrue, Mion, Zinn, Macpeak & Seas

[57] ABSTRACT

A printer ribbon distinguishing method and apparatus therefor, distinguishes a color ribbon, a black ribbon with a clear patch and a black ribbon without a clear patch in a sublimating type color printer. The apparatus has a first sensor having a characteristic in that light generated from a light emitting unit penetrates yellow, magenta and clear patches of a ribbon but does not penetrate cyan and black patches; a second sensor installed on a straight line with the first sensor widthwise of the ink ribbon and having a characteristic in that the light generated from the light emitting unit penetrates the yellow and clear patches of the ink ribbon but does not penetrate magenta, cyan and black patches; a third sensor installed on an opposite side of the first and second sensors widthwise of the ink ribbon but not on a straight line with the first and second sensors, and having a characteristic in that the light generated from the light emitting unit penetrates the yellow and clear patches but does not penetrate the magenta, cyan and black patches.

16 Claims, 3 Drawing Sheets

PRINTER RIBBON DISTINGUISHING METHOD AND APPARATUS THEREOF

FIELD OF THE INVENTION

The present invention relates to a printer ribbon distinguishing method and apparatus thereof for distinguishing between a color ribbon, a black ribbon with a clear patch and a black ribbon without a clear patch in a sublimating type color printer.

BACKGROUND OF THE INVENTION

FIG. 1 is a drawing of a conventional color printer illustrating how to distinguish a color ink ribbon 100 having a yellow patch 100*a*, magenta patch 100*b* and cyan patch 100*c* continuously coated with three colors (yellow, magenta and cyan) of sublimating type ink.

There are formed transparent and colorless clear patches 30, 31 and 32 among the yellow patch 100*a*, magenta patch 100*b* and cyan patch 100*c*.

Black markings (30*a*) (31*a*) (32*a*, 32*b*) are formed on each clear patch 30, 31 and 32 in order to distinguish the yellow patch 100*a*, magenta patch 100*b* and cyan patch 100*c* of the color ink ribbon 100.

An apparatus for distinguishing the aforesaid color ink ribbon 100 has first and second sensors 10 and 20 each having a light emitting element and a light receiving element, and first and second reflecting panels 10*a* and 20*a* for reflecting to the light receiving elements the light generated from the first and second light emitting elements 10 and 20.

Accordingly, in FIG. 1, if the color ink ribbon 100 is moved to thereby locate the clear patch 30 between the first and second sensors 10 and 20 and the first and second reflecting panels 10*a* and 20*a*, the light generated by the light emitting element of the first sensor 10 passes through the color ink ribbon 100 to thereby be reflected at the first reflecting panel 10*a*.

However, the light generated by the light emitting element of the second sensor 20 cannot penetrate the black marking 30*a*, so that the same cannot be incident upon the light receiving element.

Accordingly, a signal of high level is outputted from the first sensor 10 and a signal of low level is outputted from the second sensor 20.

As mentioned in the aforesaid, if the signals of high level and low level are respectively outputted from the first and second sensors 10 and 20, a microcomputer (not shown) recognizes the yellow patch 100*a*.

Likewise, if the color ink ribbon 100 is moved to thereby locate the clear patch located between the first and second sensors 10 and 20 and the first and second reflecting panels 10*a* and 20*a*, the first sensor 10 outputs a signal of low level by way of the black marking 31*a*, and the second sensor 20 outputs a signal of high level.

As seen from the foregoing, if the low level and high level of signals are respectively outputted from the first and second sensors, the microcomputer recognizes the magenta patch 100*b*.

Furthermore, if the color ink ribbon 100 is moved to thereby dispose the clear patch 32 between the first and second sensors 10 and 20 and the first and second reflecting panels 10*a* and 20*a*, the first and second sensors 10 and 20 respectively output signals of low levels due to the black markings.

If signals of low levels are respectively outputted from the first and second sensors 10 and 20, the microcomputer recognizes the cyan patch 100*c*.

However, by the method thus described, there has been a problem in that it is necessary to include a black marking on the ink ribbon for color recognition. Furthermore, in case a black and white ribbon is mistaken for a color ribbon, it has been impossible to distinguish this error.

Furthermore, because a first end of the black and white ink ribbon cannot be .detected, there has been a problem in that the ink ribbon has been excessively consumed.

SUMMARY OF THE INVENTION

Accordingly, it is an object of the present invention to solve the aforementioned problems and to obtain a color printer for enabling use of both a color ink ribbon and a black and white ink ribbon.

In accordance with one aspect of the present invention, there is provided a method for distinguishing ribbons of a printer, the method having:

a first step of transferring a ribbon in one direction for a predetermined period of time to thereby recognize the ribbon as a black and white ribbon with no clear patch if there is no change in an output of a second sensor;

a second step of discriminating an ink ribbon penetrability of light generated from a light emitting unit of a third sensor to thereby discriminate the ink ribbon as a black and white ink ribbon having a clear patch if the light is impenetrable, when there is a change in the output of the second sensor and the light generated from a first sensor changes from an impenetrability to an ink ribbon penetrable state; and a third step of recognizing the ink ribbon as a color ink ribbon if it is discriminated that the light generated from the third sensor at the second step is penetrable as a result of a discrimination of penetrability.

In accordance with another aspect of the present invention, there is provided a printer ribbon distinguishing apparatus, the apparatus having:

a first sensor having a characteristic in that light generated by a light emitting unit thereof penetrates yellow, magenta and clear patches of an ink ribbon but does not penetrate cyan and black patches;

a second sensor installed on a straight line with the first sensor widthwise of the ink ribbon and having a characteristic in that light generated by a light emitting unit thereof penetrates yellow and clear patches of the ink ribbon but does not penetrate magenta, cyan and black patches;

a third sensor installed on an opposite side of the first and second sensors widthwise of the ink ribbon but not on a straight line with the first and second sensors, and having a characteristic in that the light generated by a light emitting unit thereof penetrates yellow and clear patches but does not penetrate magenta, cyan and black patches; and a first and a second reflecting panels for reflecting light generated by the first, second and third sensors to a light receiving unit.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE PREFERRED EMBODIMENTS

The printer ribbon distinguishing method and apparatus thereof in accordance with the present invention will be described in detail with reference to the accompanying drawings.

Figure 1:
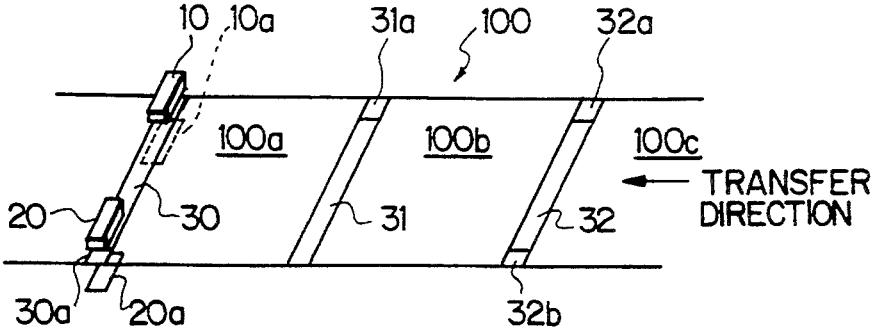
FIG. 1 is a drawing of a typical color printer for illustrating how to distinguish various locations on a color ribbon.
Figure 2A:
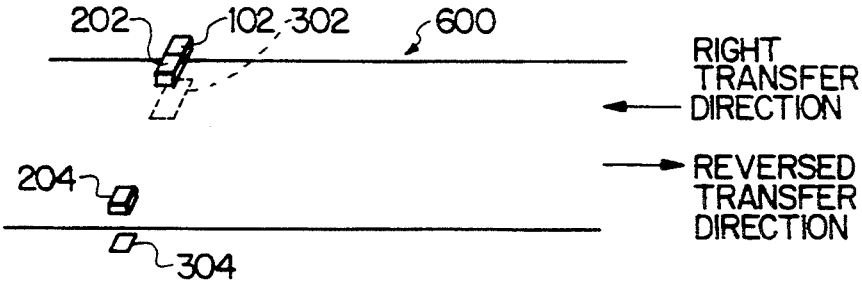
FIG. 2 is a drawing for illustrating a ribbon distinguishing method in accordance with the present invention, wherein FIG. 2(*al*) is a drawing for explaining a method to distinguish a black and white ribbon having no clear patch, FIG. 2(*b*) is a drawing for explaining a method to distinguish a black and white ribbon having a clear patch, and FIG. 2(*c*) is a drawing for explaining a method to distinguish a color ribbon.
Figure 2B:
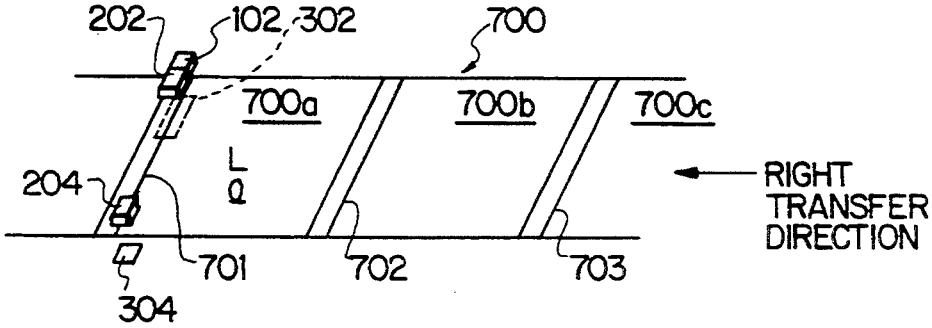

FIG. 2 is the drawing for illustrating a ribbon distinguishing method in accordance with the present invention, wherein FIG. 2(*al*) is a drawing for explaining a method as to how to distinguish a black and white ribbon 600 having no clear patch, FIG. 2(*b*) is a drawing for explaining a method as to how to distinguish a black and white ribbon 700 having clear patches (701, 702, 703, . . . ) and black patches (700*a*, 700*b*, 700*c*, . . . ) and FIG. 2(*c*) is a drawing for explaining a method as to how to distinguish a color ribbon 800 comprising a yellow patch 810, magenta patch 820, cyan patch 830 and clear patches (801, 802, 803, . . . ).

The printer ribbon distinguishing apparatus in accordance with the present invention, as illustrated in FIG. 2, has:

a first sensor 102 having a characteristic in that the light generated by the light emitting unit penetrates yellow, magenta and clear patches but does not penetrate cyan and black patches;

a second sensor 202 installed on a straight line with the first sensor 102 crosswise of the ink ribbon (600, 700 or 800) and for having a characteristic in that the light generated by the light emitting unit penetrates the yellow and clear patches of the ink ribbon but does not penetrate magenta, cyan and black patches;

a third sensor 204 installed on an opposite side of the first and second sensors 102 and 202 crosswise of the ink ribbon (600, 700 or 800) but not on a straight line with the first and second sensors (102 and 202), and for having a characteristic in that the light generated by the light emitting unit penetrates the yellow and clear patches but does not penetrate the magenta, cyan and black patches; and first and second reflecting panels 302 and 304 for reflecting the light generated from the first, second and third sensors (102, 202 and 204) of the light emitting unit to a light receiving unit.

The first, second and third sensors 102, 202 and 204 each has a light emitting unit and a light receiving unit.

The light emitting unit of the first sensor 102 has a red light emitting diode LED, and the second and third sensors 202 and 204 each have a green LED.

Accordingly, the light generated by the light emitting unit of the first sensor 102 has a characteristic in that it penetrates the yellow, magenta and clear patches but does not penetrate the cyan and black patches.

The light generated by the light emitting unit of the second and third sensors 202 and 204 has a characteristic in that it penetrates the yellow and clear patches but does not penetrate the magenta, cyan and black patches.

Meanwhile, the first and second sensors 102 and 202, as illustrated in FIG. 2(*b*), are installed on a straight line with the clear patch (701, 702 or 703), and the third sensor 204 can be installed anywhere as long as it is within a length L from the first and second sensors 102 and 202 within any color patch.

Figure 3A:
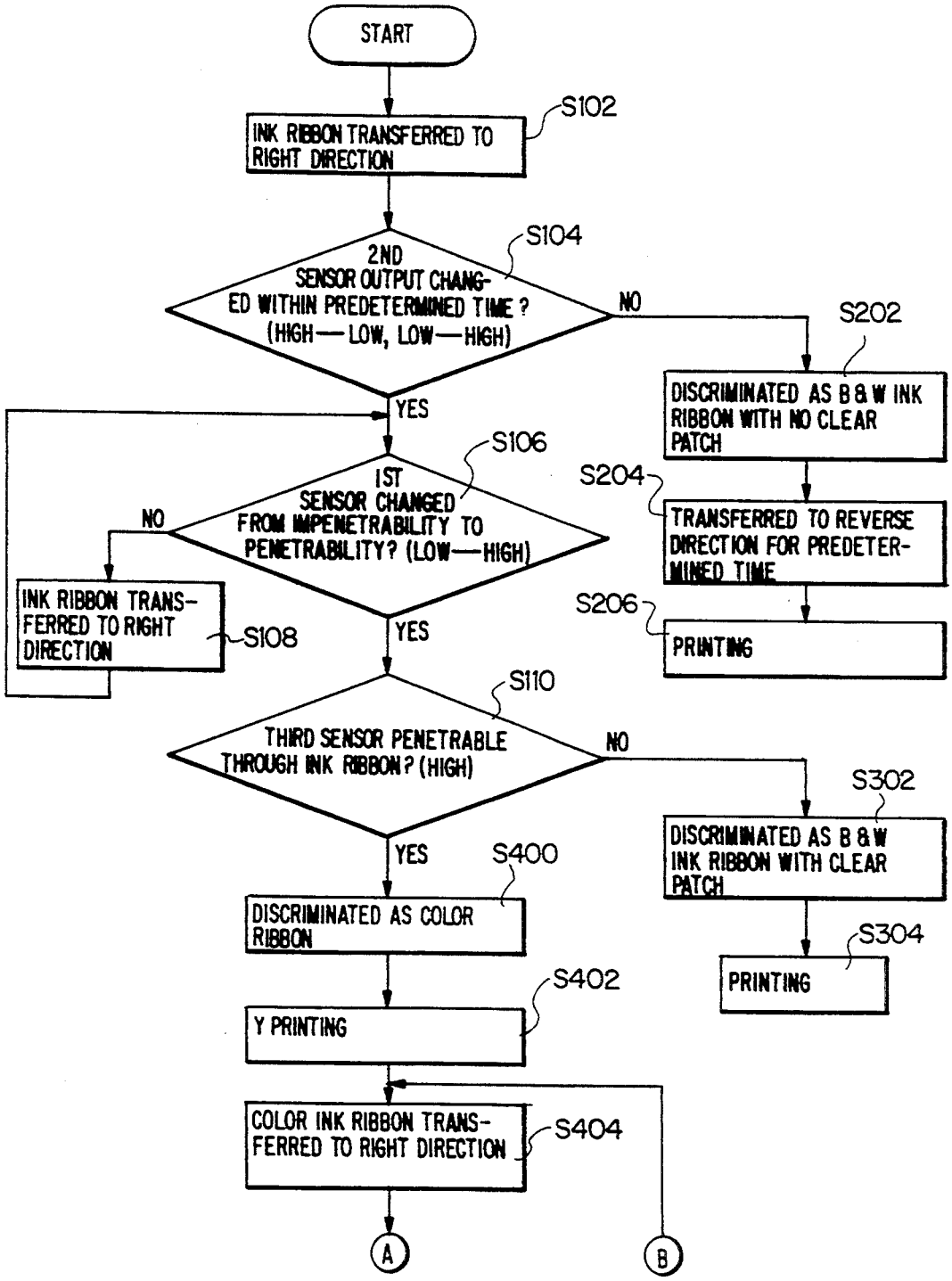
FIGS. 3(*al*) and 3(*b*) are a flow chart for explaining a printer ribbon distinguishing method in accordance with the present invention.
Figure 3B:
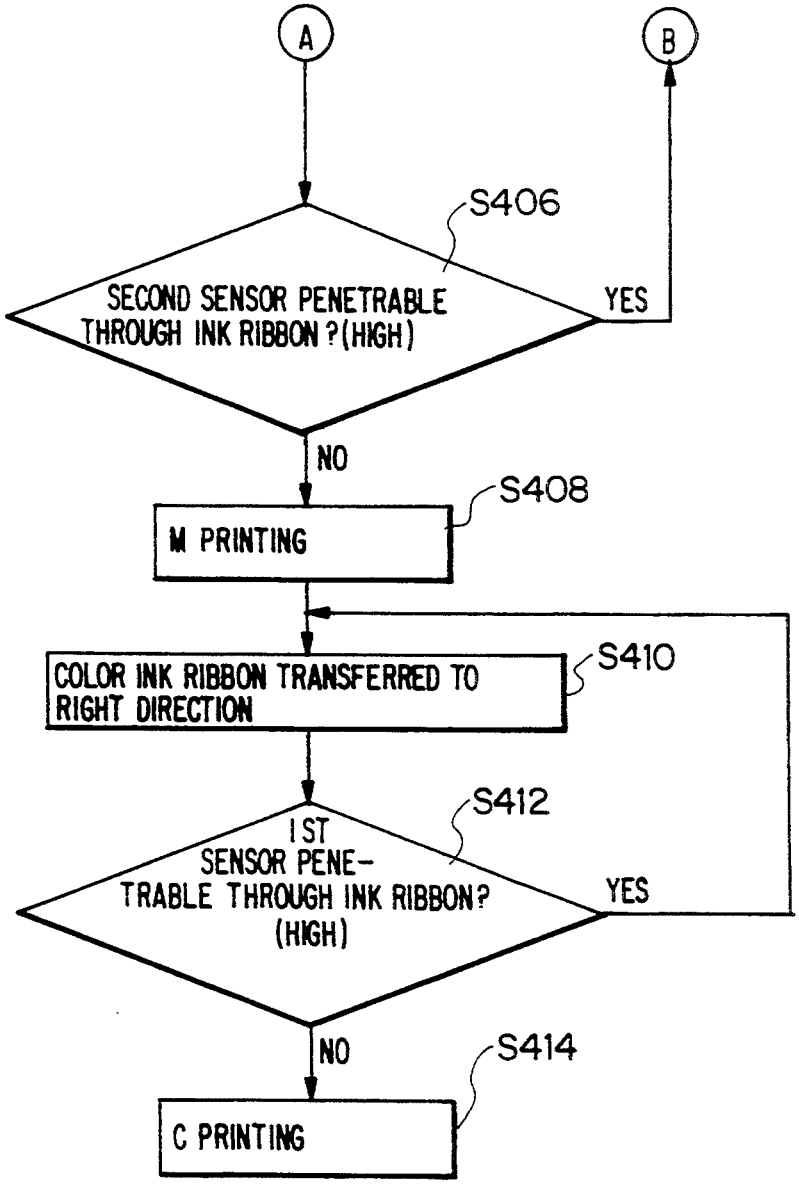

FIGS. 3(*al*) and 3(*b*) are a flow chart for explaining a printer ribbon distinguishing method in accordance with the present invention.

If a printing is started, the ink ribbon is transferred to the right direction at step S102, and a discrimination is made at step S104 as to whether an output of the second sensor 202 has changed within a predetermined period of time t (High→Low, or Low→High).

Here, the predetermined period of time t is, as illustrated in FIG. 2(*b*), the time an ink ribbon can cover a distance(l) encompassing one color of patches (700*a*, 700*b* and 700*c*) and clear patches respectively formed on either side of the color patch.

As a result of the discrimination step S104, if there is no change, the microcomputer recognizes the ink ribbon as a black and white ink ribbon with no clear patch (600, see FIG. 2(*al*) at step S202).

In other words, since the light coming out of the light emitting unit of the second sensor 202 penetrates the yellow patch and clear patch, when the ribbon is transferred for the predetermined period of time t, if there is no change in the output of the second sensor 202, the ink ribbon is recognized as the black and white ink ribbon 600 having no clear patch, as illustrated in FIG. 2(*al*).

If the ribbon is recognized as a black and white ink ribbon 600 having no clear patch at step S202, the black and white ink ribbon 600 is transferred backwards for the predetermined period of time t at step S204 to thereafter perform the printing operation at step S206.

In other words, the printing operation is performed after the black and white ink ribbon 600 has returned back to its original position.

If there has been any change in the output of the second sensor 202 at step S104, the microcomputer discriminates at step S106 whether the output of the first sensor 102 has changed from an impenetrable state (Low) to a penetrable state (High).

As a result of the discrimination at step S106, if the output of the first sensor 102 has not changed from the impenetrable state to the penetrable state, the ink ribbon is kept transferring to the right direction at step S108 to thereby repeat the step S106.

In other words, because the light outputted from the light emitting unit of the first sensor 102 cannot penetrate the cyan patch and the black patch, a continued discrimination is performed as to whether the ribbon has been transferred from the black patch of FIG. 2(*b*) (700*a*, 700*b* or 700*c*) to the clear patch (702 or 703 . . . ), or transferred from the cyan patch 830 of FIG. 2(*c*) to the clear patch 801.

If the output of the first sensor 102 has changed from impenetrability to penetrability during the repeated performances at steps S106 and S108, the computer discriminates at step S110 whether the light generated from the light emitting unit of the third sensor 204 can penetrate the ink ribbon.

As a result of the discrimination at step S110, if the light cannot penetrate, the computer recognizes the ribbon as the black and white ink ribbon with a clear patch (700; see FIG. 2(*b*)) at step S302.

In other words, if the first and second sensors 102 and 202 are positioned on the clear patch 701 of FIG. 2(*b*) or the clear patch 801 of FIG. 2(*c*), the third sensor 204 comes to position on the black patch 700*a* or yellow patch 810, and if the light outputted from the light emitting unit of the third sensor 204 does not penetrate the ink ribbon, which implies the black patch 700*a*, the computer recognizes the ribbon as the black and white ink ribbon of FIG. 2(*b*).

As a result of the discrimination at step S302, if the clear patch is recognized as the black and white ink ribbon 700, the printing operation is performed at step S304.

Figure 2C:
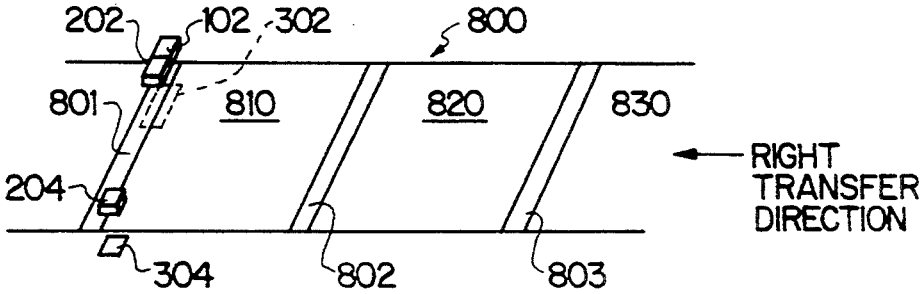

Meanwhile, if the result of the discrimination at step S110 is of a penetrable state (which means that the third sensor 204 is positioned on the yellow patch 810 of FIG. 2C) the ink ribbon is recognized as the color ink ribbon 800, step S400.

If the step S400 recognizes the ribbon as the color ink ribbon 800, yellow is printed at step S402.

Henceforth, the color ink ribbon 800 is transferred to the right direction at step S404, and it is discriminated at step S406 whether the light outputted from the light emitting unit of the second sensor 202 can penetrate the color ink ribbon 800.

As a result of the discrimination at step S406, if the light coming from the light emitting unit of the second sensor 202 is penetrable through the color ink ribbon 800, the step S404 is repeatedly performed.

During the performance of the step S406, if the light generated by the light emitting unit of the first sensor 102 is not penetrable, step S408 recognizes a magenta patch 820 and prints magenta.

In other words, if the light outputted from the light emitting unit of the second sensor 202 cannot penetrate the color ink ribbon, it means that the second sensor 202 is positioned on the magenta patch 820 and then magenta is printed.

Then, the color ink ribbon 800 is transferred to the right direction at step S410, and step S412 discriminates whether the light generated from the light emitting unit of the first sensor can penetrate the color ink ribbon 800.

As a result of the discrimination at step S412, if the light coming from the light emitting unit of the first sensor 102 can penetrate the color ink ribbon 800, the step S410 is performed again.

During the performance of the step S412, if the light generated by the light emitting unit of the first sensor 102 cannot penetrate the color ink ribbon 800, a step S414 recognizes the ribbon as a cyan patch 830 and prints cyan.

In other words, the light outputted from the light emitting unit of the first sensor 102 penetrates the yellow patch 810, magenta patch 820 and the clear patches (801, 802, 803, . . . ) but cannot penetrate the cyan patch 830, so that cyan is printed.

Furthermore, according to the present invention, the ribbons formed with black markings for classification of the ribbons can be distinguished.

In other words, if the first 102, second 202 and third sensor 204 are installed where there is no black marking on the ribbon, there will be no change of output in the sensors due to the black markings, and the distinction of the ink ribbon by the methods thus described can be possible.

Conventionally, because the black marking is formed on both ends (both ends widthwise) of the ink ribbon, the first 102, second 202, and third sensor 204, in accordance with the present invention, are installed on an inner side of the ink ribbon, so that the black markings are not detected to thereby obtain the objects of the present invention.

Accordingly, the printer ribbon distinguishing method and apparatus thereof attains an effect of distinguishing the color ink ribbon from the black and white ink ribbon.

Furthermore, in the case of the black and white ink ribbon having no clear patch, the printing can be performed after the same is transferred in the reverse direction to thereby prevent consumption of the ink ribbon.

The foregoing description of the preferred embodiments has been presented for the purpose of illustration and description. Still other variations and modifications are possible without departing from the spirit and scope of the present invention.

More specifically, though the foregoing description has only explained the use of a red LED and a green LED, it should be noted that uses of other means for creating the same effect as the use of a red or green LED, belong to the spirit and scope of the present invention.

What is claimed is:

1. A printer ribbon distinguishing method comprising:

a first step of providing three color sensors, wherein a first of said three color sensors is located above the ribbon and has a characteristic in that light which is generated by a light emitting unit of said first sensor penetrates yellow, magenta and clear patches of the ribbon, but does not penetrate cyan or black patches, wherein a second of said three color sensors is installed in a straight line with the first sensor widthwise of the ribbon and has a characteristic in that light generated by a light emitting unit of said second sensor penetrates yellow and clear patches, but does not penetrate magenta, cyan or black patches, and a third sensor installed on an opposite side of said first and second sensors widthwise of the ribbon, but not on a straight line with said first and second sensors, has a characteristic in that light generated by a light emitting unit of said third sensor penetrates yellow and clear patches, but does not penetrate magenta, cyan or black patches;

a second step of transferring the ribbon in one direction for a predetermined period of time to thereby recognize the ribbon as a black and white ribbon with no clear patch if there is no change in an output of the second sensor;

a third step of discriminating a ribbon penetrability of light generated by the light emitting unit of the third sensor to thereby discriminate the ribbon as a black and white ink ribbon having a clear patch if the light is impenetrable, when there is a change in the output of the second sensor and the light generated by the first sensor changes from a ribbon impenetrable state to a ribbon penetrable state; and a fourth step of recognizing the ribbon as a color ink ribbon if it is discriminated that the light generated by the third sensor at the third step is penetrable as a result of a discrimination of penetrability.

2. A printer ribbon distinguishing method as defined in claim 1, comprising:

a step of discriminating the ribbon as a yellow patch to thereby print yellow if the ribbon is recognized as the color ink ribbon in said fourth step;

a step of discriminating the ribbon as a magenta patch to thereby print magenta if the light generated by the second sensor does not penetrate the ribbon after yellow has been printed and the color ink ribbon has been transferred in said one direction; and a step of discriminating the ribbon as a cyan patch to thereby print cyan if the light outputted from the first sensor does not penetrate the ribbon after magenta has been printed and the color ink ribbon has been transferred in said one direction.

3. A printer ribbon distinguishing method as defined in claim 1, wherein the first, second and third sensors each comprise a light emitting unit and a light receiving unit.

4. A printer ribbon distinguishing method as defined in claim 3, wherein said light emitting unit of the first sensor includes a red light emitting diode.

5. A printer ribbon distinguishing method as defined in claim 3, wherein said light emitting units of the second and third sensors include a green light emitting diode.

6. A printer ribbon distinguishing method as defined in claim 1, wherein printing is performed after the black and white ink ribbon has been transferred in a reverse direction to said one direction by a distance equal to the transfer in said one direction if the ink ribbon is recognized as the black and white ink ribbon having no clear patch.

7. A printer ribbon distinguishing method as defined in claim 1, wherein the third sensor is installed on within a patch length of one color lengthwise of the ribbon from the first and second sensors.

8. A printer ribbon distinguishing method as defined in claim 1, wherein the ribbon is transferred in a reverse direction to said one direction for a predetermined period of time to thereby perform printing if the ribbon is recognized as the black and white ink ribbon having no clear patch.

9. A printer ribbon distinguishing method as defined in claim 1, wherein the predetermined period of time is the time the ribbon is being transferred a distance encompassing one color patch and clear patches formed on both sides of the color patch.

10. A printer ink ribbon distinguishing apparatus comprising:

a first sensor located above the ink ribbon having a characteristic in that light generated by a light emitting unit thereof penetrates yellow, magenta and clear patches of an ink ribbon but does not penetrate cyan and black patches;

a second sensor installed on a straight line with the first sensor widthwise of the ink ribbon and having a characteristic in that light generated by a light emitting unit thereof penetrates yellow and clear patches of the ink ribbon but does not penetrate magenta, cyan and black patches;

a third sensor installed on an opposite side of the first and second sensors widthwise of the ink ribbon but not on a straight line with the first and second sensors, and having a characteristic in that the light generated by a light emitting unit thereof penetrates yellow and clear patches but does not penetrate magenta, cyan and black patches; and a first and a second reflecting panel for reflecting light generated by the first, second and third sensors to a light receiving unit.

11. A printer ribbon distinguishing apparatus as defined in claim 10, wherein the first, second and third sensors each comprise a light emitting unit and a light receiving unit.

12. A printer ribbon distinguishing apparatus as defined in claim 11, wherein the light emitting unit of the first sensor includes a red light emitting diode.

13. A printer ribbon distinguishing apparatus as defined in claim 11, wherein the light emitting units of the second and third sensors include green light emitting diodes.

14. A printer ribbon distinguishing apparatus as defined in claim 10, wherein the first and second sensors are installed on the straight line widthwise of the ink ribbon.

15. A printer ribbon distinguishing apparatus as defined in claim 10, wherein the third sensor is installed within a patch length of one color lengthwise of the ribbon from the first and second sensors.

16. A printer ribbon distinguishing apparatus as defined in claim 10, wherein the first and second sensors and the third sensor are installed on a place free from black markings on the ribbon.

* * * * *